US005503204A

United States Patent [19]

Byers et al.

[11] Patent Number: 5,503,204

[45] Date of Patent: Apr. 2, 1996

[54] INTERCHANGEABLE FLAP HANDBAG

[76] Inventors: Madonna O. Byers; Carolyn K. Parker, both of 7130 Blenheim Palace Ln., Houston, Tex. 77095

[21] Appl. No.: 296,009

[22] Filed: Aug. 25, 1994

Related U.S. Application Data

[63] Continuation of Ser. No. 78,736, Jun. 16, 1993, abandoned.

[51] Int. Cl.[6] ..... A45C 1/02; A45C 3/08

[52] U.S. Cl. ..... 150/105; 150/103; 150/118; 150/128

[58] Field of Search ..... 150/103–105, 150/118, 119, 128

[56] References Cited

U.S. PATENT DOCUMENTS

| | | | |
|---|---|---|---|
| 1,747,801 | 2/1930 | Topal | 150/104 |
| 1,927,590 | 9/1933 | Isaacson | 150/105 |
| 1,990,360 | 1/1935 | Anish | 150/28 |
| 2,080,453 | 5/1937 | Kraut | 150/104 |
| 2,093,097 | 9/1937 | Potash | 150/105 |
| 2,627,885 | 2/1953 | Cassell | 150/105 |
| 2,711,203 | 6/1955 | Gerder | 150/104 |
| 2,723,696 | 11/1955 | Kase | 150/104 X |
| 2,784,756 | 3/1957 | Resnick | 150/103 |
| 2,796,105 | 6/1957 | Hyman | 150/119 |
| 2,798,524 | 7/1957 | Ryon | 150/103 |
| 3,335,775 | 8/1967 | Adams | 150/119 X |
| 4,027,710 | 6/1977 | Keebler | 150/28 |
| 4,962,800 | 10/1990 | Owiriwo | 150/118 X |
| 5,009,319 | 4/1991 | Jantzen | 206/544 |

FOREIGN PATENT DOCUMENTS

| | | | |
|---|---|---|---|
| 22728 | 12/1935 | Australia | 150/103 |
| 597563 | 5/1960 | Canada | 150/105 |
| 803118 | 1/1969 | Canada | 150/118 |
| 2629794 | 10/1989 | France | 150/103 |
| 223823 | 10/1924 | United Kingdom . | |
| 307269 | 3/1929 | United Kingdom . | |
| 340415 | 1/1931 | United Kingdom | 150/105 |
| 1089413 | 11/1967 | United Kingdom | 150/105 |
| 2186625 | 8/1987 | United Kingdom | 150/118 |

*Primary Examiner*—Sue A. Weaver
*Attorney, Agent, or Firm*—Matthews & Assoc.; J. Albert Riddle

[57] ABSTRACT

A purse has interchangeable variegated closure flaps which can be selectively attached and retained to the purse body by a spring loaded toggle lock and hasp system.

11 Claims, 4 Drawing Sheets

FIG. 1
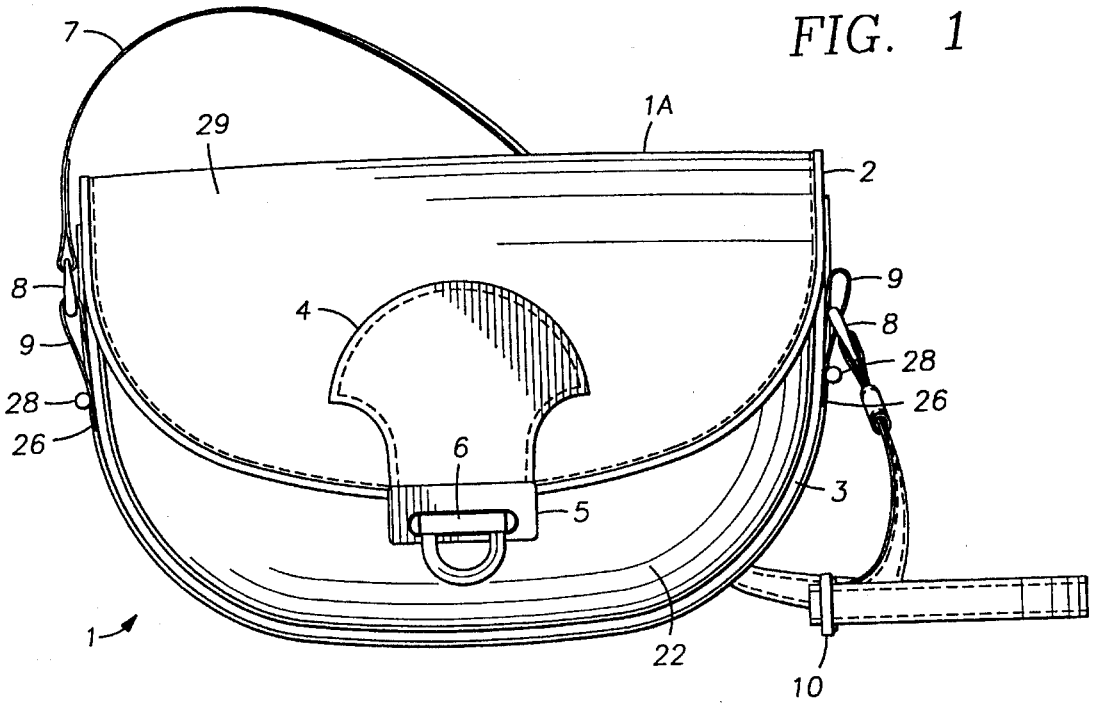
FIG. 2
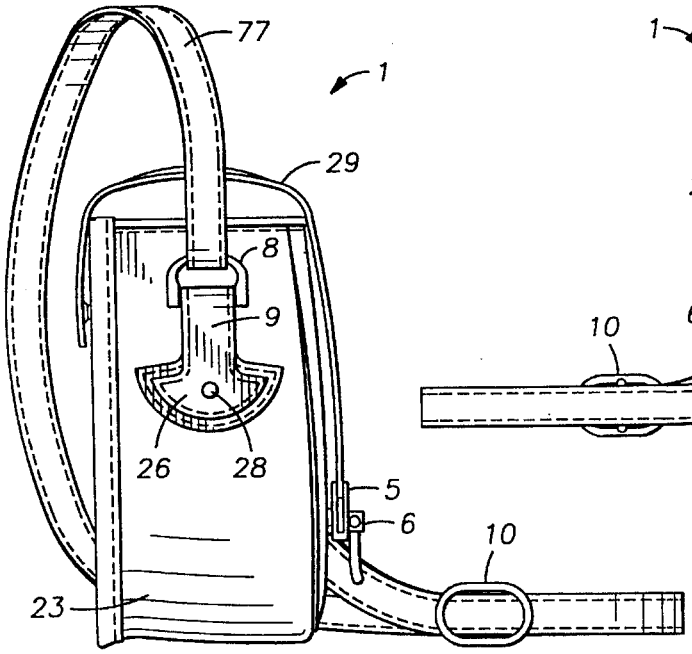
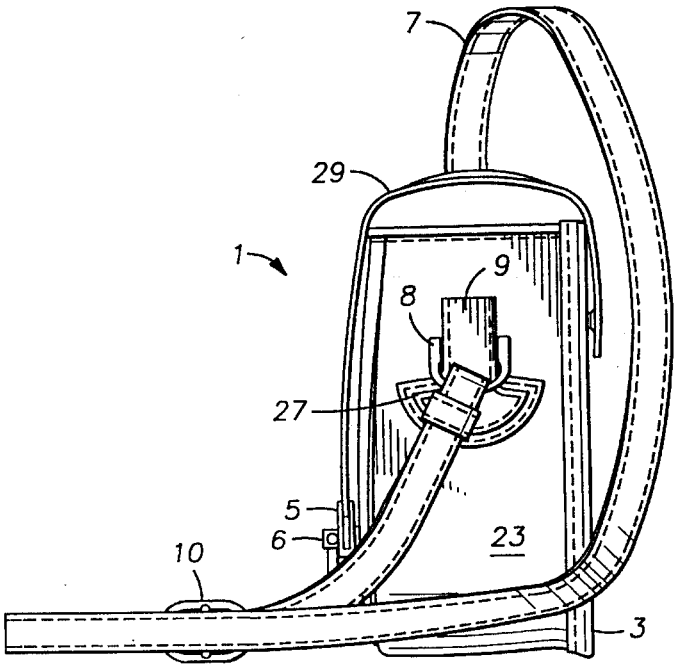
FIG. 3

INTERCHANGEABLE FLAP HANDBAG

This is a continuation of application Ser. No. 08078,736 filed on Jun. 16, 1993, and now abandoned.

This invention relates generally to an improved handbag system. The invention is most particularly concerned with basic handbag shapes which can be fitted with detachable, fingernail friendly, variegated closure flaps.

BACKGROUND AND PRIOR ART

Today as in many past decades, there is a strong demand for attractive and functional handbags. Handbags are carried by innumerable people. From a functional standpoint, the conventional handbag is difficult to improve upon, however, aesthetically speaking, the handbag market is an open market dictated by ever changing fashions and etiquette. Many people spend an extraordinary amount of time searching for a particular handbag for a certain outfit or for a special occasion or even to express an individual statement. In the lifetime of one individual, a multitude of handbags of varying fashions and colors and materials are collected and categorized and sometimes stored for decades awaiting their special moments to be used or make a statement. In some societies both sexes carry handbags, in others, only women. The handbag business is big business, and although there is extensive prior art patenting there is room for improvement.

Prior art foreign patents Cassgrain 2,629,794 (Fr), Litewsky 223,823 (UK), Stuben 307,269 (UK), and Anish U.S. Pat. No. 1,990,360, Topal U.S. Pat. No. 1,747,801, Kraut U.S. Pat. No. 2,080,453, Potash U.S. Pat. No. 2,093,097, Kase U.S. Pat. No. 2,723,696, Resnick U.S. Pat. No. 2,784,756, Ryon U.S. Pat. No. 2,798,524, Keebler U.S. Pat. No. 4,027,710 and Jantzen U.S. Pat. No. 5,009,319 demonstrate variable handbag and flap designs in the art. Each of these references is hereby fully incorporated by reference for all disclosed.

The Litewsky reference (UK) is for a clutch style handbag fashionable in the 20's and 30's with a rear pocket and with detachable flaps that fit within the rear pocket and are retained by press button snaps. The basic style and embodiments of this handbag varies greatly from the present invention Bogey handbag system.

The Stuben reference discloses a clutch purse with a detachable cover to both sides of the handbag. As with the Litewsky reference the cover is attached by an insertion flap that fastens with press button snaps and slips into a rear pocket of the handbag.

The Anish reference also discloses a clutch style bag with reversible outer covers attached to both upper sides of the handbag with press button snaps and optional snap in flaps hooking on both sides of the purse.

The Topal reference also discloses a clutch style bag with detachable closure flaps retained by press button snaps in a concealed pocket on the rear of the purse.

The Kraut reference discloses a purse with a detachable reversible closure flap that envelops both sides of the mouth of the purse and snaps into place, opening on either side.

The Potash reference discloses a clutch style bag with a reversible detachable cover attached by press button snaps that envelops the body of the purse and is also centered by a small handle on the back of the purse.

The Kase reference discloses a rigid box like handbag with press button snap on cover flaps of various materials and with optional snap on handles.

The Cassgrain reference discloses a handbag, portfolio or travel bag with a removable cover flap that can vary in shape or color which attaches to the body of the handbag by zipper, hook and loop, or press button snaps.

The Resnick reference discloses a handbag that has a reversible and variable cover member for both sides with openings for the purse handle reinforced with flexible plastic inserts.

The Ryon reference discloses a purse with a cover flap that fits into a reinforced metal slot with hinged catch on the bottom of the purse and which wraps around the back and front secured by press button snaps and a rotating front latch.

The Keebler reference discloses a purse with a plurality of attached facing members, secured and rotating from a hinge on the bottom of the purse and held in place by a rotating bar clasp.

The Jantzen reference discloses a purse system where softer materials can be used to construct a purse reinforced by flexible plastic inserts. It discloses several embodiments and in some instances detachable flaps using hook and loop for reattachment.

All of the above prior art references disclose handbags of varying styles and changeable outer appearances. The present invention is an improved handbag system in that in incorporates certain features to allow for better construction, attractiveness and finishing so that they appear to be conventionally constructed "designer" handbags, but actually are much more versatile, cost effective, and convenient, with the additional collection of flaps available. The present invention differs from the disclosures set out in the references because the method of attaching the flaps with the spring drop locks or spring toggle and hasp closure provides for a new, improved, and more secure attachment of flap to handbag body unlike the other patented purses using snaps, hook and loop, and other fasteners which are less reliable when subjected to heavy use or use over a long period of time. Furthermore the spring drop locks or spring toggle and hasp closure of the present invention will not snag and break expensively manicured fingernails.

The closures disclosed in the prior art are either not secure and easy to manipulate with long fingernails, or are very difficult to manipulate with long fingernails if strong enough to retain the purse flap. It is an important consideration to adequately fasten the flap since valuables and important items such as licenses, ID. cards, credit cards and the like are routinely carried in purses. This method of attachment is additionally well suited for the aged population with impaired manual dexterity. The present invention, in addition to combining secure fasteners and ease of use is more readily adaptable to compliment the perceived construction features found in a conventional single flap "designer" handbag.

Unlike all of the prior art referenced the closure of the present invention does not add an extra layer of bulk or thickness at the attachment point. In addition only three toggle lock hasps suffice operate to both secure the flap to the purse body proper and to hold the flap securely closed. This is distinguishable from the prior art which attempts to solve attachment and closure problems with numerous press snaps, long bulky hook and loop, zipper closures or other complicated attachment systems. The present invention also differs from the prior art references because the removable flaps are often constructed with trim that matches or complements the body of the handbag. Consequently, even if a contrasting color is selected for a flap, as compared to the bag body, it is still trimmed with a color that matches or compliments the handbag body helping to create the look of a "designer" handbag of conventional manufacture. The final result is a unique handbag system which can be simply and safely altered allowing the consumer more flexibility to create the styles desired while always maintaining the appearance and reliability of a quality product which can be used for many years.

SUMMARY OF THE INVENTION

The present invention relates to an improved handbag system allowing for a method of combining a basic designer handbag body with one or more closure flaps which come in varying colors, textures, and designs. This handbag system allows the consumer more freedom and input into the design of their handbag and also allows them to recycle the basic handbag body and completely change the look of their handbag to correspond with changes of wardrobe, by altering the handbag flaps.

While alternative flaps for ladies handbags can be found in the prior art, the particular handbag of the present invention overcomes a number of problems with the prior art in that the flaps are releasably attached to the body of the handbag by two polished metal spring loaded toggle locks which fit through reinforced metal hasp openings in the upper edge of the back wall of the handbag. The movable portion of the toggle folds over to retain and secure the flap. In the preferred embodiment the clasp is thus of the hasp type. The spring loading provides both for extra secure positioning in the fastened position and an over-center action that will snap the toggle open as it is unfolded from the fastened position to the release position. The shape of the end of the movable portion of the toggle in the preferred embodiment disclosed is curved or configured so that one fingertip, even with a long nail, can manipulate it and thus operate the toggle with one finger and no risk of damaging the nail. These drop locks or toggle locks allow for rapid and easy attachment and removal of the flap from the body of the handbag. Furthermore this improved method of fastening will not snag and break fingernails since the toggles don't require manipulation by fingertips. This feature is of particular importance as the purchasers of highly styled designer handbags are very likely to also have long expensively manicured fingernails. The front of the flap has a magnetic snap closure or other suitable closures such as another spring toggle and hasp lock assembly.

In this invention, the flaps are available in leather of many colors, varying animal prints and different colored skins. There are also available custom designed flaps. When a contrasting flap is selected it is edged and finished with leather to match the body of the basic handbag. This allows for a finished product which looks like a designer handbag, regardless of which flap is used on the body of the handbag.

This handbag system is not meant to be an inexpensive method to expand the services of one handbag, nor replace all other handbags in one's wardrobe. It does give the consumer a great amount of versatility and is especially ideal for travel, and storage by being so space saving.

DESCRIPTION OF THE DRAWINGS

FIG. 1 shows a front view of one embodiment of the present invention.

FIG. 2 and FIG. 3 are side views of one embodiment of the present invention.

DETAILED DESCRIPTION

Figure 4:
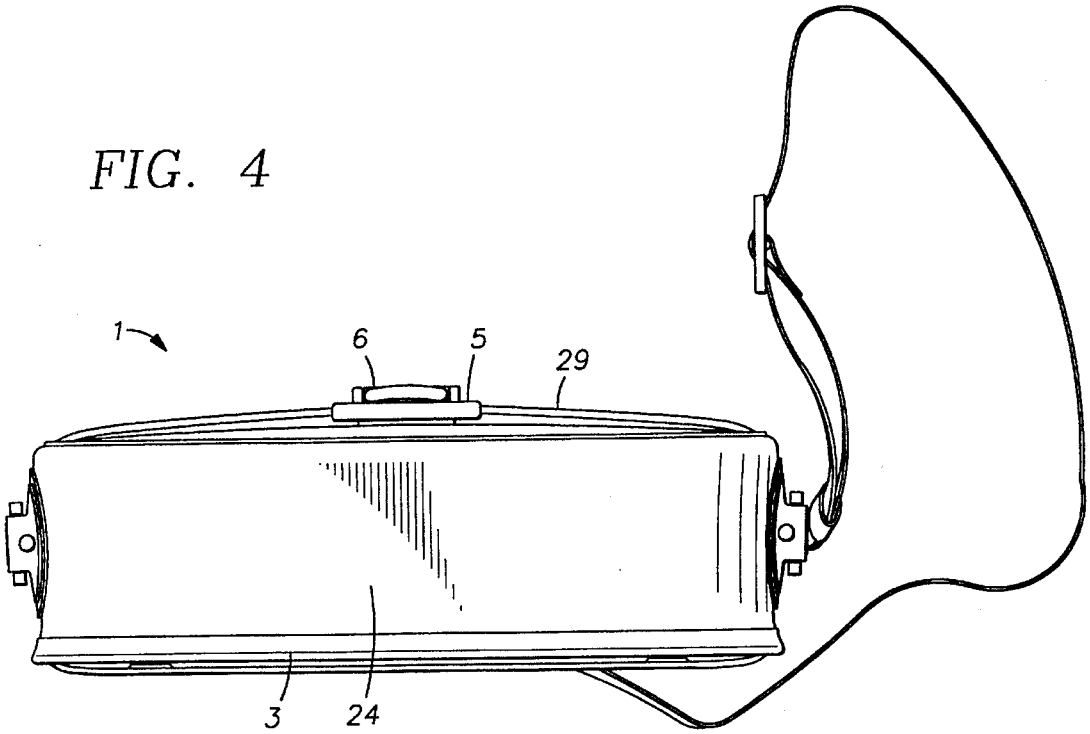
FIG. 4 is a bottom view of the present invention.

The preferred embodiment of the present invention will now be described with reference to the accompanying figures.

FIG. 1 depicts a front elevation of the present invention with detachable closure flap 1 and reinforced flap trim 2 which can correspond or contrast with the body 1 of the handbag. The reinforced trim 3 on the body of the handbag normally matches the color of the body of the handbag. The trim 3 and 3A also covers an internal seam at the same location. The appearance of the present invention from this figure is one of that of a usual handbag. The reinforced trim 3 serves a plurality of functions. It strengthens the internal front seams of the handbag so that a person can carry weighted objects and so the handbag can endure daily use and it also makes the handbag and flap ensemble appear more like a single unit, especially when the flap differs from the handbag body in color, texture or design. FIG. 1 also shows decorative trim 4 and latch assembly 6 centered on front flap 1A and corresponding with latch catch 5. The decorative front trim 4 can also match compliment or contrast with the reinforced trim 3 on a bag with a contrasting flap further helping to affirm the look of a "designer" handbag of the usual well made one piece construction. Latch catch 5 can vary in appearance and dimension corresponding with the handbag style chosen. The latch catch is of a smooth polished metal in the illustrated preferred embodiment. Strap 7 is also depicted with adjustable buckle 10 in the preferred embodiment although alternative configurations are known to those of skill in the art. The strap 7 is of sturdy well made construction with smooth polished metal attachments 8 affixed to either end and with attachments 8 fixable in turn to bag body via the side attachment portion 9. The adjustable buckle 10 is also of the same smooth polished metal as the latch catch 5 in the preferred embodiment. It allows for the length of the strap 7 to be adjustable which is a feature of many well made designer handbags. The front 22 of the handbag body 1 is also shown. In this figure the handbag is shown with a semi circular shaped body but the present invention may include handbags with square, rectangular, trapezoidal and semicircular shapes.

FIG. 2 and FIG. 3 show side views with side attachment base and loop 9 for strap 7 which has metal ring 8 for hinged joining of strap to side attachment 9 located on both sides 23 of the body of the Bogey handbag. Base 26 of the loop 9 is secured to the side 23 of the bag body 1 by sewn stitches 27 in the preferred embodiment or other suitable means, leaving loop 9 free of the bag body 1. The loop 9 may optionally be fastened to the base 26 and side 23 permanently by a stud fastener or releasably by button means at 28. A releasable means enables easier swapping of the strap 7 to coordinate with the variegated closures possible with the present invention, and also permits replacement of the strap 7 when worn out, a possibility given the extended opportunities for use the present invention permits by virtue of its adaptable appearance and quality constructed main body. All of the metal fixtures in the preferred embodiment are smooth and polished. Other configurations may be derived by those of skill in the art in light of the present disclosure, but the present invention uses metal rings 8, and a base 26 and loop 9 of material the same as or similar to that the bag body 1 is fashioned from, or high quality leather in the preferred embodiment. The hinged joining of the strap to the body of the handbag permitted by the illustrated configuration allows for manipulation and use of the purse without being encumbered by a handbag strap which without hinges could hinder easy access to the inside contents of the handbag when opening and closing the handbag flap. This feature is also an additional feature found on more expensive "designer" handbags. FIGS. 2 and 3 also show side elevations of a detachable closure flap 29 in the closed position. Furthermore FIGS. 2 and 3 allows the viewer to see that the bag has an appearance of a conventionally constructed "designer" bag from the side of a handbag, with no tell tale extra layers visible.

FIG. 4 is the bottom view of the present invention showing bag bottom 24 with reinforced trim 3 on back seams and bottom view of a front closure with latch assembly 6 and latch catch 5.

Figure 5:
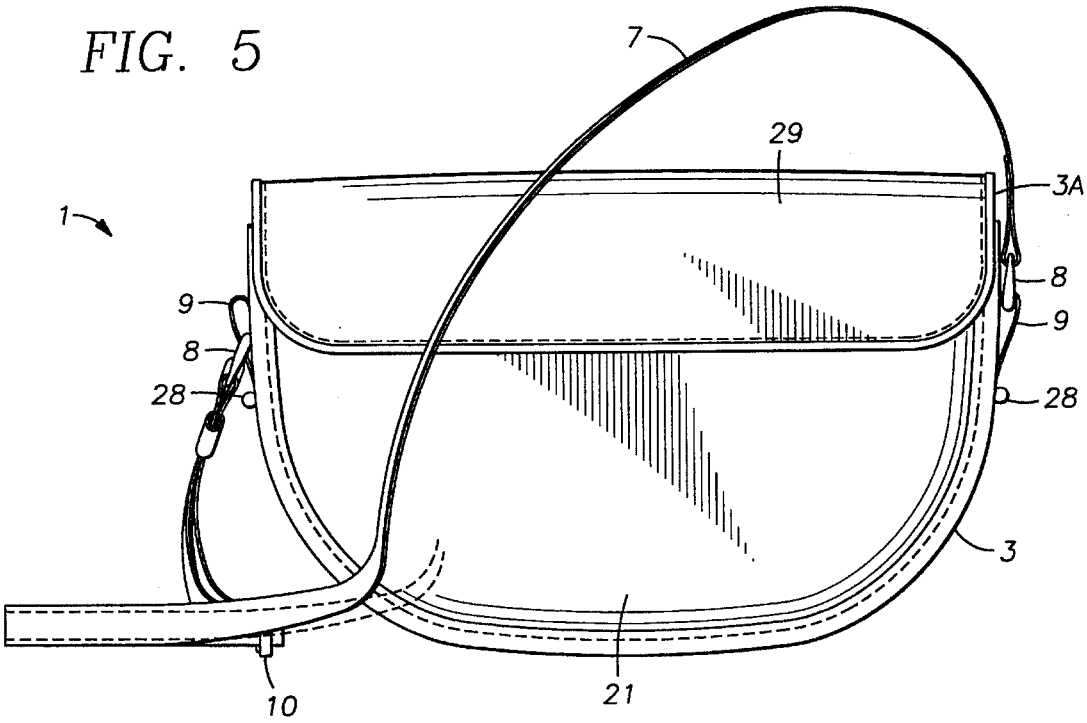
FIG. 5 is a back view of the present invention.

FIG. 5 is the back view of the Bogey bag with the back wall 21 of the purse body and back view of flap 29. Once again there are no detectable features from the back view that reveal the fact that the handbag has a detachable flap 29. In particular there is no added thickness or bulk such as results from the interposition of hook and loop fasteners, zipper or press snap closures.

Figure 6:
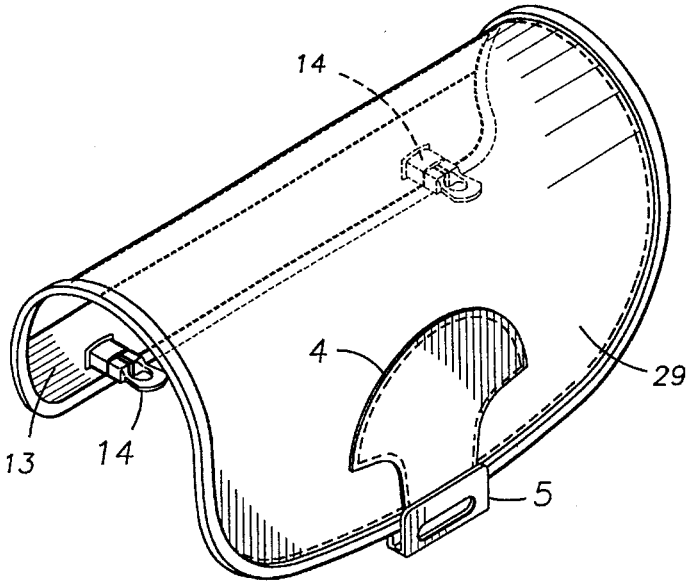
FIG. 6 is a view of a detachable flap of the present invention.

FIG. 6 is the detached closure flap 29 showing positioning of spring toggle locks 14 located on reinforcing band 13 sewn on inner surface of the back of flap 29. Band 13 gives strength to the back of the flap and also allows for the hardware that attaches the spring toggle locks 14 to the flap 29 to be contained on the front and back sides of the band 13 so that the hardware is concealed from view an is not visible on the outside of the handbag flap 29, as readily apparent from FIG. 5. The hardware in the preferred embodiment comprises a reinforcing polished metal plate 12 for the outside and metal brad fasteners for the opposite side which together form a metal reinforced hasp opening for the toggle 14. It is very important in a well made handbag which a consumer expects to use frequently and for an extended period of time, to have the mechanism of attachment be well secured and structurally able to withstand repeated uses. The band 13 allows for this reinforcement, and prevents the flap material from tearing while also helping to prevent to spring drop locks or spring toggle locks 14 from loosening or detaching.

Figure 7:
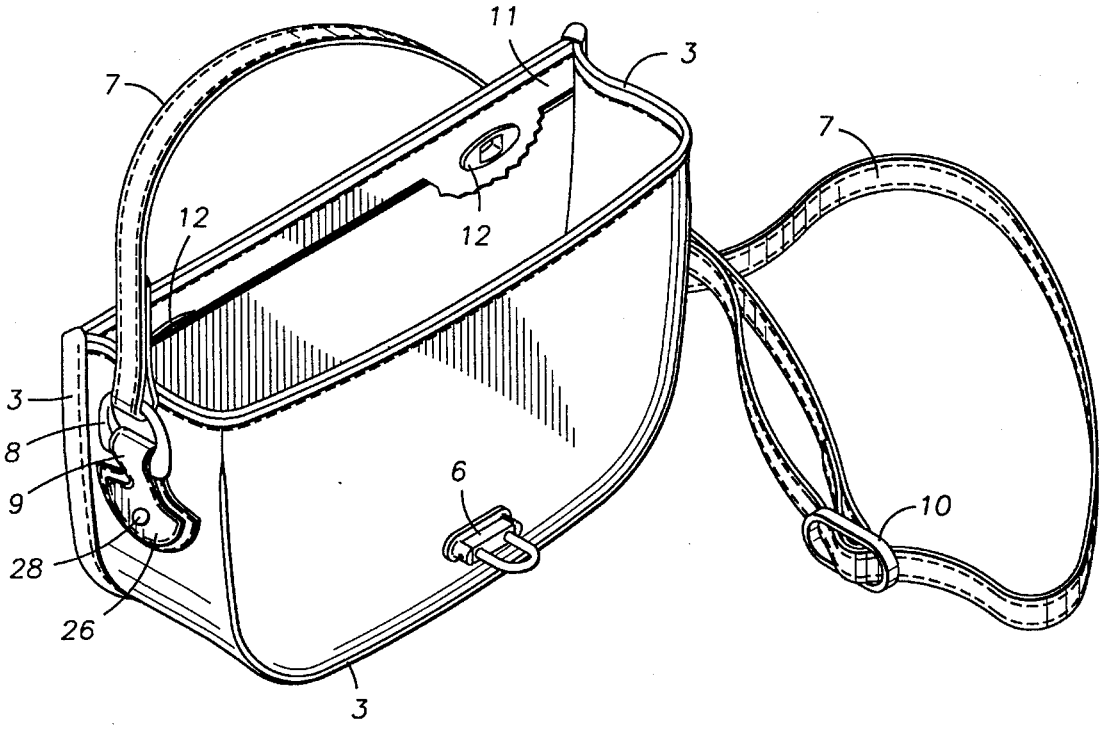
FIG. 7 is the body of the present invention without a flap attached.

FIG. 7 is the body of the bag without flap 29 positioned, depicting an open latch assembly 6, reinforced band 11 sewn across the back inner surface of back wall 21 of handbag body, with metal reinforced hasp openings 12 through the back wall 21 and with reinforcing band 11 separating or dividing the back wall and hasp openings from the remaining interior of the purse defined by back wall 21 front wall 22 the side walls 23 and bottom 24. Band 11 allows for the back wall of the handbag body to be doubled in thickness and therefore of much greater strength. The reinforcing band 11 can also be extended the full depth of the purse and is desired sewn or otherwise secured to form a dividing pocket rather than a dividing band. The addition of metal reinforced hasp openings 12 to the reinforced double thickness of the band plus the back of the handbag body creates very strong receptacles and a foundation for attachment of the spring drop locks and thus the closure flap. The metal hasp openings are smoothly polished and flush with the handbag body so they do not catch fingernails or objects.

Figure 8:
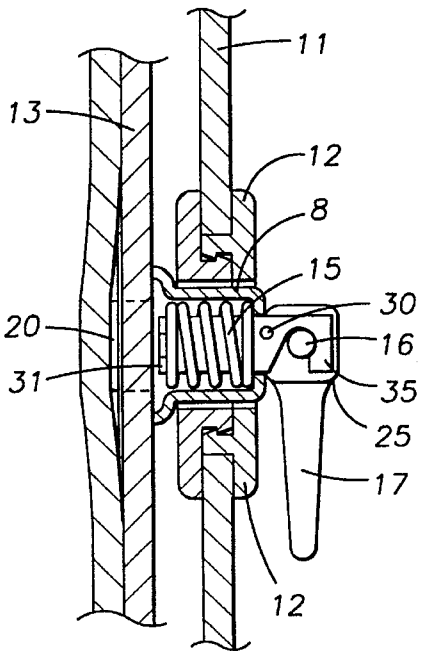
FIG. 8 is a cross section view of the spring drop lock when the toggle is folded closed as seen from the side.

FIG. 8 is a cross section side view of spring drop lock or spring toggle lock 14 on flap 29 secured within metal reinforced hasp opening 12 through the handbag body. This figure shows the drop lock spring 15, depicted within a metal encasement 18 with drop lock hinge pin 16 depicted fitted through the flat faced metal base 25 of the toggle and the hinge piston 30. The base 25 is cut by a slot 33 perpendicular to hinge pin 16. Hinge piston 30 comprises piston head 31, and piston stem 32. The end 35 of the piston stem 32 opposite the piston head 31 protrudes through an opening 34 in the spring encasement 18. End 35 is configured to fit into the slot 33 in toggle base 25 and to link with the hinge pin 16 either as shown in the preferred embodiment as a hook end or alternatively by drilling a hole through end 35 through which pin 16 can pass. When assembled as shown in the drawings the piston stem 32 resides within the spring 15. The spring is compressed with one end bearing against the interior face of the piston head 31 and the opposite end bearing against the interior of the encasement 18. The end 35 of the stem 32 opposite the head 31 protrudes through opening 34 in the encasement 18. The toggle 14 is connected by pin 16 to the end 35, and the action of the compressed spring serves to draw a flat face of the toggle base 25 against the flat face of the outside of the spring encasement 18 and thus to retain the toggle 14 in it position either opened or closed as the case may be. To use, after inserting each drop lock or extended toggle lever 17 through the respective metal reinforced hasp openings 12, and into the space between the inside of the rear wall 12 and the reinforcing band 13 one simply flips down folding lever 17 and the flap is securely attached by the action of spring 15 in combination with the flat faces of the toggle base 30 and encasement 18. To remove the flap, one simply lifts up the lever 17. The spring loading can provide both for extra secure positioning in the fastened position and an over-center action that will snap the toggle 17 open as it is unfolded from the fastened position of FIG. 8 to the release position of FIG. 9 and as the toggle base 25 switches from one flat face to another. The shape of the distal end of the movable portion of the toggle 17 in the preferred embodiment disclosed is curved in at least one plane or otherwise configured so that one fingertip, even with a long nail, can manipulate it and thus operate the toggle with one finger and no risk of damaging the nail. These drop locks or toggle locks allow for rapid and easy attachment and removal of the flap 29 from the body 1 of the handbag. Furthermore this improved method of fastening will not snag and break fingernails since the toggles don't require manipulation by fingertips. This feature is of particular importance as the purchasers of highly styled designer handbags are very likely to also have long expensively manicured fingernails.

Drop lock or toggle lock attachment or anchor base 19 is seen positioned on the front of reinforcing band 13 on flap 1A, and anchoring brad portion 20 of the drop lock assembly is shown on the rear of reinforcing band 13. The mechanical portions of the spring drop locks 14 are all contained in smooth metal encasements to prevent the snagging of fingernails, prevent pinching and also allow for easy manipulation.

Figure 9:
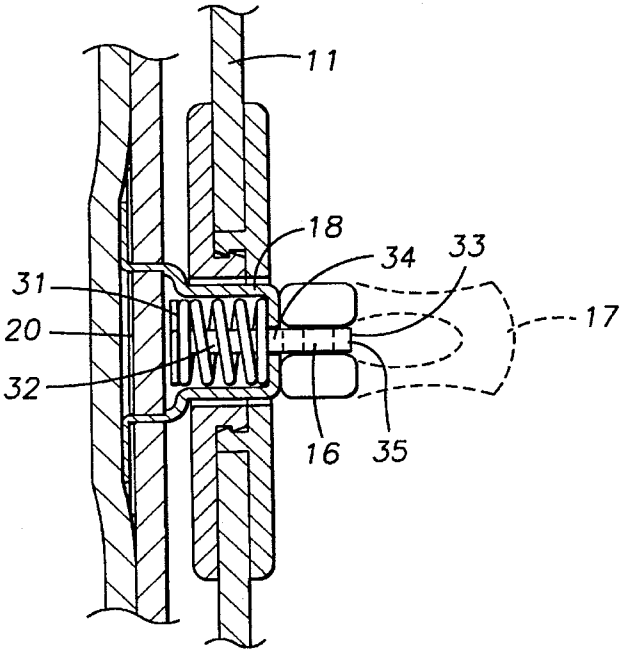
FIG. 9 is a cross section view of the spring drop lock when the toggle is extended and open, as seen from the top.

FIG. 9 depicts a top view in cross section of drop lock 14 inserted in metal reinforced hasp opening 12 with lever 17 in ghost view in the extended open or unlocked position.

Figure 10:
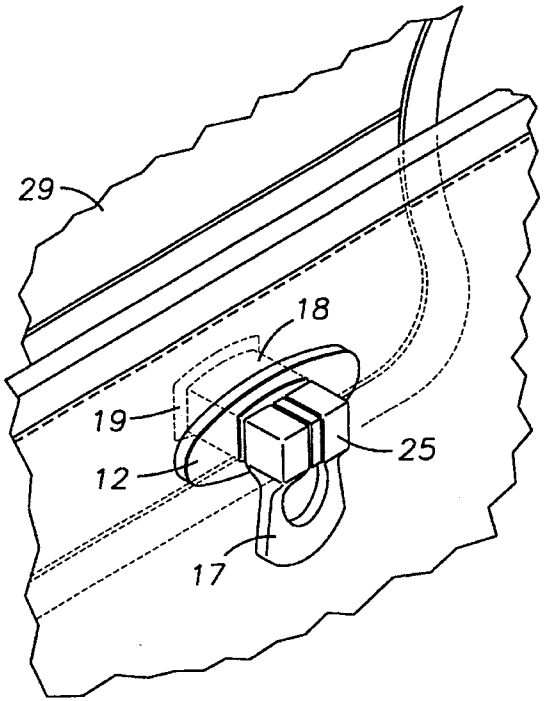
FIG. 10 is an enlarged detail view of the spring drop lock when in the toggle is folded closed, as seen from the interior of the purse.

FIG. 10 is an enlarged detail front view of drop lock 14 fastened within metal reinforced hasp opening 12. The drop lock 14 is in the secured downward or closed and folded position within the body 1 of the handbag.

From the above description and reference to the figures, the simplicity of attaching and detaching handbag flaps is self evident and the preservation of expensively manicured fingernails is enhanced because the metal fixtures to attach flap to handbag are of smooth rolled polished metal. The mechanism and use of the hinged or folding drop lock 14 is secure and easily operated. It is to be understood that the complete system of the present invention has a variety of bag designs and flap designs and colors and textures with front flap closures that can vary, i.e. magnetic, latch, buckle closures. Bags in accordance with the present invention are constructed with reinforced seams and panels and smooth polished metal fixtures. All bags have as a primary feature multiple optional and separately purchased detachable closure flaps of varying styles and designs. In addition the shoulder strap can be an optional feature and the length size and coloration of the strap and decorative and reinforcing trim can be designed to contrast with or match with the coloration of the handbag. The assembled bag has an appearance of a well constructed, expensive handbag. The handbag system of the present invention is much more versatile than it appears to be, because of the detachable closure flaps. The spring drop locks are easy to position in the metal openings of the body of the handbag and simply and safely turned downward to lock securely onto the handbag body. There is no worry about ruining beautiful fingernails.

The foregoing disclosure and description of the invention are illustrative and explanatory thereof, and various changes in size, shape and materials, as well as the details of the illustrated construction and sequence of the steps may be made without departing from the spirit of the invention.

What is claimed:

1. A handbag comprising: (a) an open topped body, said body having a rear wall with upper and lower edges and provided with at least one reinforced opening near the upper edge of said rear wall; (b) removable and interchangeable flaps having front and back edges, and inner and outer surfaces; (c) at least one spring biased drop lock positioned along the inner surface of the back edge of each of said flaps, said drop lock being further aligned such that it may be received by said reinforced opening when the flap is being attached to said body, said drop lock including: (i) a flat faced lever; (ii) a housing containing a piston wherein said housing is substantially rectangular with a top end and a base end, said top end being substantially open and inwardly flanged and wherein said base end expands to a size larger than the remainder of said housing; (iii) said piston maintained substantially within said housing and containing first and second ends with a piston head integrally formed at said first end and being configured to fit within a slot in said lever at said second end; (iv) said lever being horizontally pivotably attached to said piston at said second end of said piston; and (v) a spring surrounding said piston and bearing against said piston head at one end and said flange at said other end so as to maintain pressure on said lever through said piston in order to allow the lever to be switched from one stable position to another to allow for removing and interchanging said flaps; and (d) a fastening means for releaseably attaching said front edge of said interchangeable flaps with said body.

2. The invention in claim 1 wherein said reinforced opening in the body of the rear wall of said handbag is reinforced with metal.

3. The invention in claim 2 wherein said body rear wall with metal reinforced opening further includes a reinforcing panel on the inner surface of said rear wall.

4. The invention of claim 1 wherein said drop lock is fabricated of rolled polished metal.

5. The invention in claim 1 wherein said fastening means comprises: (a) at least one drop lock fixedly attached to said outer body; and (b) a reinforced opening juxtaposed to said front edge of said interchangeable flaps, said reinforced opening corresponding to said drop lock attached to said body.

6. The invention in claim 1 wherein said body is comprised of multiple panels sewn together thereby creating reinforced joined seams.

7. The invention of claim 6 wherein trim is affixed to said joined seams to further reinforce said seams.

8. The invention in claim 1 wherein said flaps have reinforcing trim that matches with the color of the body of the handbag.

9. The invention in claim 1 wherein said flaps have reinforcing trim that contrasts with the color of the body of the handbag.

10. The invention in claim 1 wherein the said inner surface of the back edge of said flaps have a reinforcing panel.

11. A handbag comprising: (a) an open topped body, said body having a rear wall with upper and lower edges and provided with at least one reinforced opening near the upper edge of said rear wall; (b) removable and interchangeable flaps having front and back edges, and inner and outer surfaces; (c) a plurality of spring biased drop locks positioned along the inner surface of the back edge of each of said flaps, said drop locks including: (i) a flat faced lever; (ii) a housing containing a piston wherein said housing is substantially rectangular with a top end and a base end, said top end being substantially open and inwardly flanged and wherein said base end expands to a size larger than the remainder of said housing; (iii) said piston maintained substantially within said housing and containing first and second ends with a piston head integrally formed at said first end and being configured to fit within a slot in said lever at said second end; (iv) said lever being horizontally pivotably attached to said piston at said second end of said piston; and (v) a spring surrounding said piston and bearing against said piston head at one end and said flange at said other end so as to maintain pressure on said lever through said piston in order to allow the lever to be switched from one stable position to another, (d) means for attaching said drop locks to said flaps; (e) a fastening means for releaseably attaching said front edge of said interchangeable flaps with said body; (f) a shoulder strap releasably affixed to said body; and (g) a reinforcing panel affixed to said inner surface of the back edge of said interchangeable flaps, wherein said reinforcing panel conceals said means for attaching said drop locks to said interchangeable flaps.

* * * * *